United States Patent [19]

Blain et al.

[11] Patent Number: 4,932,502

[45] Date of Patent: Jun. 12, 1990

[54] HYDRAULIC ELEVATOR SYSTEM

[75] Inventors: Jeffrey W. Blain, Scenic Lakes Township; David S. Kutz, Randolph, both of N.J.

[73] Assignee: Inventio AG, Hergiswil, Switzerland

[21] Appl. No.: 310,553

[22] Filed: Feb. 15, 1989

[51] Int. Cl.[5] ..... B66B 1/04

[52] U.S. Cl. ..... 187/111

[58] Field of Search ..... 187/110, 111

[56] References Cited

U.S. PATENT DOCUMENTS

| | | | |
|---|---|---|---|
| 3,570,243 | 3/1971 | Comer et al. | 60/52 |
| 3,977,497 | 8/1976 | McMurray | 187/111 |
| 4,311,212 | 1/1982 | Simpson | 187/111 |
| 4,469,199 | 9/1984 | Polis et al. | 187/122 |
| 4,470,482 | 9/1984 | Husson | 187/118 |
| 4,548,296 | 10/1985 | Hasegawa | 187/17 |
| 4,775,031 | 10/1988 | Nakamura et al. | 187/111 |

*Primary Examiner*—A. D. Pellinen
*Assistant Examiner*—W. E. Duncanson, Jr.
*Attorney, Agent, or Firm*—D. R. Lackey

[57] ABSTRACT

A hydraulic elevator system 10 having an elevator car 12 in which car velocity V and car position L are determined by detecting the quantity Q of hydraulic fluid transferred between a hydraulic cylinder and a hydraulic fluid reservoir. The car velocity V is directly proportional to Q and the car position L is directly proportional to the integral of Q. The car velocity V, or quantity Q, is compared with a desired velocity pattern, or desired flow rate pattern, PG, and the difference is a control signal C which is used to control the quantity Q. The car position L may also be used to determine the distance-to-go to a target floor, which may be used to initiate slowdown and/or to calculate all, or selected portions of, the desired pattern PG.

6 Claims, 2 Drawing Sheets

HYDRAULIC ELEVATOR SYSTEM

TECHNICAL FIELD

The invention relates in general to elevator systems, and more specifically to elevator systems in which movement of an elevator car is responsive to movement of the plunger of a hydraulic jack.

BACKGROUND ART

As described in U.S. Pat. No. 4,469,199, which is assigned to the same assignee as the present application, hydraulic elevator systems are normally controlled by indicia in the hatchway which cooperate with electrical switches carried by the elevator car. First and second vertical lanes of indicia, such as cams, establish slowdown distances relative to each floor, one for each travel direction, third and fourth vertical lanes of indicia alternately notch a floor selector, to eliminate false actuation of the selector due to contact bounce, and a fifth lane of indicia mount landing cams, which are also used when re-leveling is necessary. Each vertical lane of indicia requires a vertical tape in the hatchway which adds substantially to the initial cost of an elevator system, as well as to maintenance costs and thus it would be desirable and it is an object of the present invention, to reduce the number of such lanes.

The slowdown and landing indicia are used to control a hydraulic elevator valve, which typically includes up level, up stop, down level and down stop solenoids, as well as check and relief valves. The solenoids initiate preset speeds as the elevator car approaches and stops at a target floor. It would be desirable and is another object of the present invention to be able to control the speed, acceleration, and deceleration of a hydraulic elevator based upon car positional information which continuously indicates car position, without requiring tapes or other positional indicating devices in the hatchway.

DISCLOSURE OF THE INVENTION

Briefly, the present invention is a new and improved hydraulic elevator system which detects and controls the quantity Q of hydraulic fluid transferred between a reservoir of such fluid and the cylinder of a hydraulic jack. The position of the elevator car is continuously determined from Q, as car position is directly proportional to the integral of Q. The car velocity is also continuously determined from Q, as car velocity is directly proportional to Q. The actual Q at any instant is compared with the desired Q to provide an error signal which forces Q to follow the desired pattern during a run of the elevator car to a target floor. With positional information continuously available, the distance of the car from the target floor is determined, eliminating the need for slowdown cams to initiate a preset speed pattern change. Also, instead of using the positional information merely to initiate different sections of a preset speed pattern, the positional information may be used to determine the distance-to-go to the target floor. The distance-to-go information may then be used to calculate all, or selected portions of, the speed pattern. This gives the elevator controller a wide range of speeds, accelerations and decelerations with which it can operate the elevator car, making it easy to handle varying floor heights and to improve the smoothness and accuracy of floor landings. The elevator speed, being regulated, is now relatively independent of travel direction, oil temperature, weight of the elevator car and its load, and position of the car in the hatchway.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENT

Figure 1:
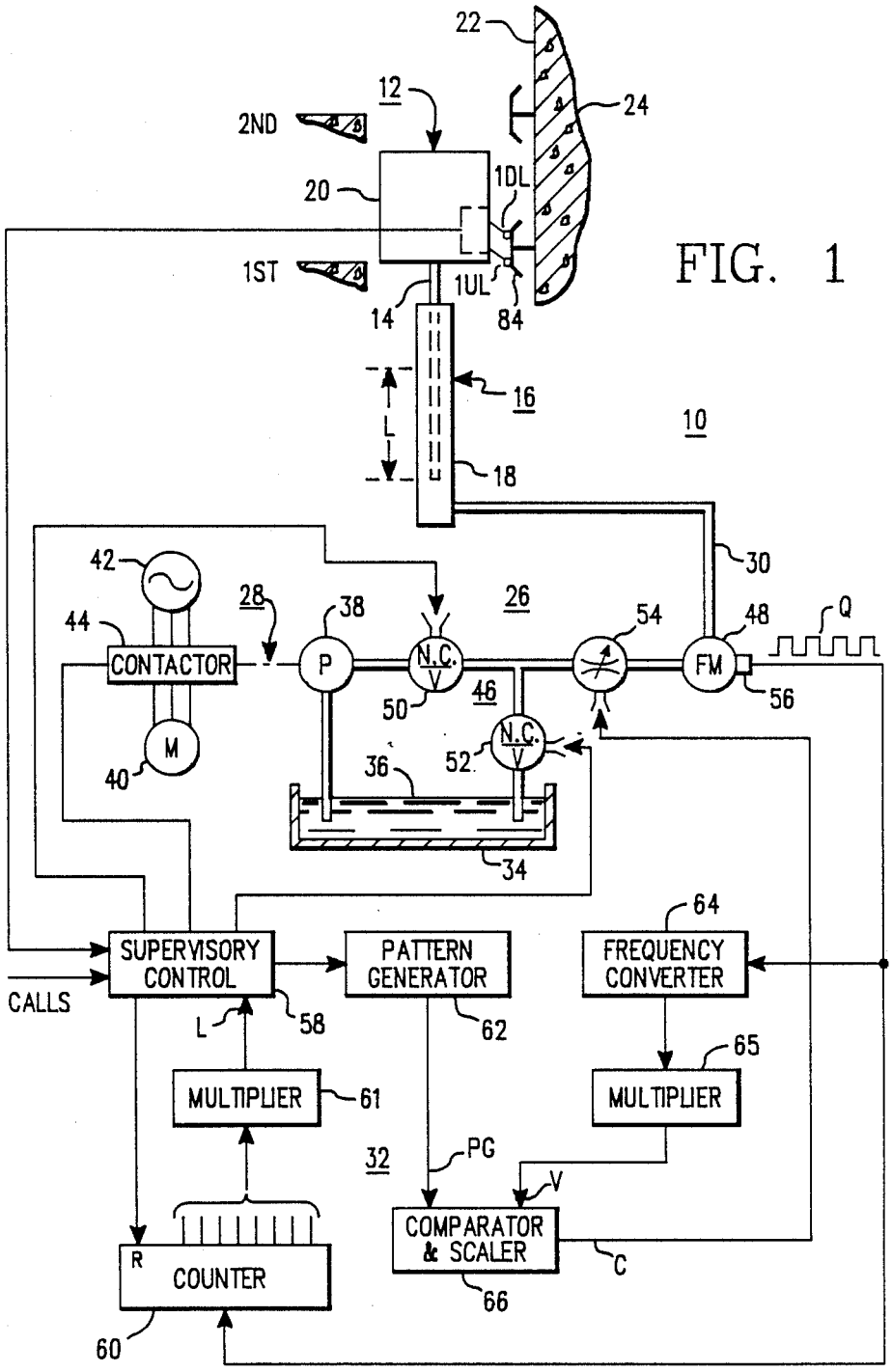
FIG. 1 is a partially schematic and partially block diagram of a hydraulic elevator system constructed according to the teachings of the invention.

Referring now to the drawings, and to FIG. 1 in particular there is shown a hydraulic elevator system 10 constructed according to the teachings of the invention. The invention relates to any elevator system having a car 12 whose movement is responsive to the movement of a plunger 14 of a hydraulic jack 16, which also includes a cylinder 18. A conventional hydraulic elevator system 10 is illustrated in FIG. 1, in which the elevator car 12, which includes a passenger cab 20 and sling (not shown), is mounted on the end of plunger 14. The invention, however, also applies to roped hydros.

Elevator car 12 is mounted for guided movement in the hatchway 22 of a structure or building 24 having floors to be served by the elevator car 12, with the first and second floors of building 24 being illustrated. Motive means for elevator car 12 includes a hydraulic circuit or system 26 comprising the hereinbefore mentioned jack assembly 16, a hydraulic power unit 28, suitable piping 30 which provides fluid flow communication between the power unit 28 and the jack assembly 16, and an electrical controller 32. Electrical controller 32 operates the power unit 28 to serve calls for elevator service generated from hall call buttons associated with the floors of building 24 and from car call buttons located in the elevator cab 20. The various hall call and car call buttons are not shown as they may be conventional.

The hydraulic power unit 28 includes a supply or reservoir 34 of hydraulic fluid 36, such as hydraulic oil, a pump 38, such as a constant displacement pump, a motor 40 for driving pump 38, a source 42 of electrical potential, a line starter or contactor 44 for controllably connecting source 42 to motor 40, valve means 46 and a flowmeter 48.

Valve means 46 includes first and second normally closed solenoid valves 50 and 52, respectively, and a variable-orifice valve 54 which may be controlled in response to a voltage applied thereto. Valve 50 is opened when elevator car 12 travels in the up direction, and valve 52 is opened when elevator car 12 travels in the down direction.

Flowmeter 48 provides a measure of the flow rate of hydraulic fluid 36 flowing between hydraulic system 46 and hydraulic jack 16. In a preferred embodiment this measure is in the form of a pulse train Q whose rate is responsive to the rate of fluid flow. For example, flowmeter 48 may be in the form of a turbine having vanes which rotate at a speed responsive to flow rate. Small magnets may be carried by the tips of the vanes which are detected by a magnetic pickup 56.

The controller 32 includes supervisory control 58 which, among other things, energizes the up and down direction solenoid valves 50 and 52 when appropriate, means 60 for providing a signal responsive to the integral of Q, such as a counter, a multiplier function 61 for multiplying the integral of Q by a predetermined constant, means 62 for generating a pattern of desired car velocity, which may be a pattern of desired flow rate at any instant which will result in the desired car velocity, a frequency converter 64 for converting the pulse train Q to a voltage or value indicative of actual flow rate, a multiplier function 65 for multiplying Q by a predetermined constant, which is required if pattern generator 62 provides a speed pattern instead of a flow rate pattern, and a comparator and scaler 66 which provides the required voltage at any instant for operating valve 54 to cause the actual car velocity and rate-of-change of velocity to track the desired car velocity and rate-of-change of velocity.

The volume of hydraulic oil in the cylinder 18 is related to oil flow rate Q as follows:

$$\frac{\pi D^2 L}{4} = \int_0^t Q\,dt \tag{1}$$

The length of the cylinder 18 occupied by the hydraulic oil is indicated by L, which also directly indicates the position of the elevator car 12, and the internal diameter of cylinder 18 is indicated by D. Thus, the position L of the elevator car is equal to:

$$L = \frac{4}{\pi D^2} \int_0^t Q\,dt \tag{2}$$

The velocity V of the car 12 is equal to the differential of L, and letting the constant in front of the integral in equation (2) be equal to "K", we have:

$$V = dL/dt = KQ \tag{3}$$

Controller 32 regulates the speed of car 12 by monitoring the flow rate Q and it adjusts the variable orifice valve 54 until the actual flow rate Q matches the desired flow rate at any instant. The controller 32 also integrates the actual flow rate Q and calculates the position of the elevator car in the hatchway 22.

More specifically, controller 32 detects the frequency or rate of the pulses of the pulse train Q by applying them to the frequency converter 64. Converter 64, for example, may be a frequency-to-voltage converter which provides a voltage having a magnitude which is directly responsive to the flow rate Q; or, converter 64 may be a read-only memory, with the frequency being used to access a look-up table which outputs a value responsive to flow rate. If pattern generator 62 provides a desired flow rate pattern, the output of converter 64 may be directly applied to comparator 66. If pattern generator 62 provides a desired car velocity, the output of converter 64 is multiplied by the constant K in the multiplier function 65 to obtain the actual velocity V of the elevator car 12.

Comparator and scaler 66 compares the actual car speed V with the desired car speed PG and provides a control signal C having a magnitude necessary to control the orifice opening of valve 54 to cause the actual car speed to track the desired car speed.

Figure 2:
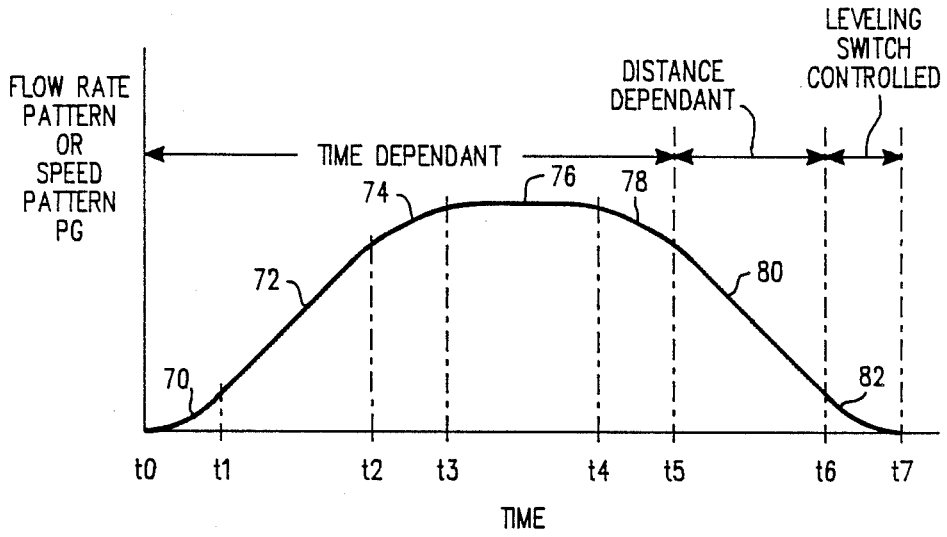
FIG. 2 illustrates a pattern which may be wholly or partially developed from elevator car positional information developed according to the teachings of the invention.

Pattern generator 62 may provide a flow pattern, or a speed pattern, as desired, which may be a predetermined pattern stored in a memory. The different parts of the pattern may be initiated according to time, and at fixed distances from a target floor. On the other hand, the pattern, or parts thereof, may be calculated from car positional information generated according to the teachings of the invention. FIG. 2 illustrates a typical pattern PG, which may be a flow rate pattern, or a speed pattern. For purposes of example, it will be assumed to be a speed pattern. Pattern PG is initiated by supervisory control 58 at time t0 and from time t0 to time t1 the speed pattern provides a smooth, jerk limited transition 70 from zero velocity to a constant acceleration rate. The speed increases along portion 72 until approaching the desired constant speed at time t2, where a transition 74 occurs between constant acceleration at time t2 and constant speed at time t3. The pattern remains at constant speed during a portion 76 until the car 12 reaches a point where deceleration must be initiated to make a normal stop at a target floor, which occurs at time t4. A transition 78 smoothly blends from constant velocity to constant deceleration at time t5, and a constant velocity portion 80 continues until a landing cam 84 at the target floor, shown in FIG. 1, is detected at time t6 by either switch 1DL or switch 1UL, carried by the elevator car 12. Switch 1DL will make the initial contact with cam 84 in the up travel direction, and switch 1UL will make the initial contact in the down travel direction. Switches 1DL and 1UL are landing and re-leveling switches, as described in the hereinbefore mentioned U.S. Pat. No. 4,469,199, which patent is hereby incorporated into the specification by reference. A transition 82 then occurs which smoothly blends the constant deceleration to zero speed at time t7. As shown in FIG. 2, pattern portions 70, 72, 74, 76 and 78 are normally time based, and portions 80 and 82 are distance based.

All of pattern PG may be calculated using the car positional information developed by the invention; of portions thereof may be calculated, such as the distance based portion 80, as desired. U.S. Pat. No. 4,470,482, which is assigned to the same assignee as the present application, teaches a calculated speed pattern based upon car positional information, and this patent is hereby incorporated into the specification of the present application by reference.

Figure 3:
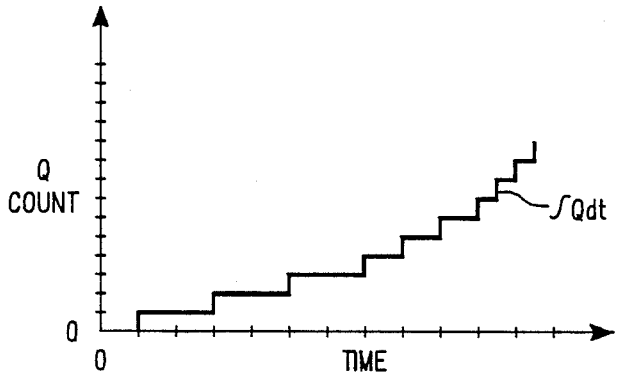
FIG. 3 is a graph which illustrates how the integral of the hydraulic fluid flow rate Q may be developed by a counter.

The car positional information is conveniently generated from signal Q by counter 60, which, as shown in FIG. 3, integrates Q. Multiplying the count on counter 60 in the supervisory control by the constant K, provides the car position L. This information may be used to calculate the time based portions of the pattern, and this information may be used, along with the position of the target floor, to determine distance-to-go, which is used in the calculation of the distance based portion 80 of the speed pattern PG.

In summary, there has been disclosed a new and improved hydraulic elevator system which provides continuous elevator positional information without the necessity of installing tapes and position readers in the hatchway. Thus, with the positions of the floors stored in a memory, the elevator controller 32 can tailor a speed pattern for each floor for optimum smoothness and efficiency of elevator service, taking into account the location of the car, the length of the run, the distance between floors, the load in the elevator car, the direction of travel, the temperature of the hydraulic fluid 36, and the like. Speed, acceleration, and deceleration may all be selected and changed to suit the present conditions. The normal slowdown cam lanes and floor selector notching lanes are not required, thus reducing the initial cost of the elevator system, as well as reducing maintenance costs.

We claim:

1. A hydraulic elevator system, comprising:

a hydraulic jack having a cylinder and plunger, an elevator car mounted for movement in response to movement of said plunger, a hydraulic circuit for operating said hydraulic jack, including a supply of hydraulic fluid, a pump, and a motor for operating said pump, adjustable valve means in the hydraulic circuit, a flow rate detector for providing a signal Q responsive to the rate of flow of hydraulic fluid in the hydraulic circuit, means responsive to the signal Q for determining the velocity V of the elevator car, means responsive to the integral of the signal Q for determining the position L of the elevator car, and supervisory control means responsive to the velocity V and the position L for controlling said motor and said adjustable valve means to provide a desired operation of said elevator car.

2. The hydraulic elevator system of claim 1 wherein the signal Q is a pulse train, the means for determining the speed V of the elevator car includes means for detecting the frequency of the pulse train, and the means for determining the position L of the elevator car includes means for counting the pulses of the pulse train.

3. The hydraulic elevator system of claim 1 wherein the supervisory control means includes means generating a pattern PG indicative of the desired velocity of the elevator car, means comparing the velocity V of the elevator car with the pattern PG to provide a control signal C responsive to any difference between the desired and actual velocities, with the adjustable valve means being controlled in response to the control signal C.

4. The hydraulic elevator system of claim 1 wherein the supervisory control means initiates slowdown of the elevator car in response to the position L of the elevator car.

5. The hydraulic elevator system of claim 1 wherein the adjustable valve means includes up and down solenoid valves, and a controllable orifice valve.

6. The hydraulic elevator system of claim 1 wherein the supervisory control means, in response to the position L of the elevator car, determines the distance-to-go to a target floor, and calculates at least a portion of the pattern PG in response to said distance-to-go.

* * * * *